United States Patent [19]

Masuda et al.

[11] 4,386,328

[45] May 31, 1983

[54] HIGH FREQUENCY FILTER

[75] Inventors: Yoshio Masuda; Atsushi Fukasawa; Takuro Sato; Tatsumasa Yoshida; Hiromi Ando, all of Tokyo, Japan

[73] Assignee: Oki Electric Industry Co., Ltd., Tokyo, Japan

[21] Appl. No.: 254,071

[22] Filed: Apr. 14, 1981

[30] Foreign Application Priority Data

| | | | |
|---|---|---|---|
| Apr. 28, 1980 | [JP] | Japan | 55-55520 |
| Sep. 9, 1980 | [JP] | Japan | 55-124021 |
| Dec. 10, 1980 | [JP] | Japan | 55-173105 |

[51] Int. Cl.[3] ..... H01P 1/205; H01P 1/208; H01P 7/00

[52] U.S. Cl. ..... 333/202; 333/208; 333/222

[58] Field of Search ..... 333/202-212, 333/219-225, 235, 245

[56] References Cited

U.S. PATENT DOCUMENTS

| | | | |
|---|---|---|---|
| 3,505,618 | 4/1970 | McKee | 333/303 |
| 4,179,673 | 12/1979 | Nishikawa et al. | 333/202 X |
| 4,283,697 | 8/1981 | Masuda et al. | 333/202 |

*Primary Examiner*—Marvin L. Nussbaum
*Attorney, Agent, or Firm*—Armstrong, Nikaido, Marmelstein & Kubovcik

[57] ABSTRACT

A high frequency filter for frequencies higher than the VHF band comprising of a closed conductive housing (53), a pair of input and/or output means (54) like an antenna provided at both the extreme ends (53-5, 53-6) of said housing (53), a plurality of resonators (51-1 through 51-5, and **51*a*-1 through 51*a*-5) arranged on a straight line between said antennas (54), each of said resonators having an elongated inner conductor (51*a*-1 through 51*a*-5) with a circular cross section, and an elongated rectangular dielectric body (51-1 through 51-5) surrounding said inner conductor, one end of each of said resonators being fixed at the single plane (53-1) of the housing (53) and the other end of each of said resonators being free standing. The length of said inner conductor and the dielectric body is substantially ¼ wavelength, and the duration (52-1 through 52-4) between two resonators is determined according to the specified coupling coefficient for the desired characteristics of the filter. Due to the rectangular dielectric body (51-1 through 51-5), each resonator is stably mounted on the housing (53), and then, the stable characteristics of the filter is obtained. Thus, the use in a vibrated circumstance like a mobile communication is possible. That rectangular dielectric body (51-1 through 51-5)** also provides the larger coupling coefficients between resonators, and then, the wideband filter can be obtained.

17 Claims, 29 Drawing Figures

HIGH FREQUENCY FILTER

BACKGROUND OF THE INVENTION

The present invention relates to a high frequency filter, in particular, relates to a novel structure of a bandpass filter of dielectric waveguide type, which is suitable for use especially in the range from the VHF bands to the comparatively low frequency microwave bands. The present filter relates particularly to such a filter having a plurality of resonator rods each coupled electrically and/or magnetically with the adjacent resonators, and can be conveniently installed in a mobile communication system.

Such kind of filters must satisfy the requirements that the size is small, the energy loss in a high frequency is small, the manufacturing process is simple, and the characteristics are stable.

When a filter is composed of a plurality of elongated rod resonators, the size of each resonator and the coupling between resonators must be considered.

First, three prior filters for the use of said frequency bands will be described.

FIG. 1A shows the perspective view of a conventional interdigital filter, which has been widely utilized in the VHF bands and the low frequency microwave bands. In the figure, the reference numerals 1-1 through 1-5 are resonating rods which are made of conductive material, 2-1 through 2-4 are gaps between adjacent resonating rods, and 3 is a case. The 3-1 through 3-3 are conductive walls of said case 3. A cover 3-4 of the case 3 is not shown for the sake of the simplicity of the drawing. A pair of exciting antennas 4 are provided for the coupling of the filter with an external circuit. The length of each illustrated resonating rod 1-1 through 1-5 is selected as to be substantially equivalent to one quarter of a wavelength, and one end of the resonating rods are short-circuited alternately to the confronting conductive walls 3-1 and 3-2, while the opposite ends thereof are free standing.

As is well known, when a resonator stands on a conductive plane, a magnetic flux distributes so that the density of the magnetic flux is maximum at the foot of the resonator, and is zero at the top of the resonator, while the electrical field distributes so that said field is maximum at the top of the resonator and the field at the foot of the resonator is zero. Therefore, when a pair of resonators are mounted on a single conductive plane, those resonators are coupled with each other magnetically and electrically, and the magnetic coupling is performed at the foot of the resonators, and the electrical coupling is performed at the top of the resonators. However, since the absolute value of the magnetic coupling is the same as that of the electrical coupling, and the sign of the former is opposite to the latter, the magnetic coupling is completely cancelled by the electrical coupling, and as a result, no coupling is obtained between two resonators.

In order to solve that problem, an interdigital filter arranges the resonators alternately on a pair of confronting conductive walls. In that case, the two adjacent resonators are electrically coupled with each other as shown in FIG. 1B, where the magnetic flux M which has the maximum value at the foot of the resonator does not contribute to the coupling of the two resonators since the foot of the first resonator 1-1 located far from the foot of the second resonator 1-2, and so, only the electrical field E contributes to the coupling of the two resonators.

However, said interdigital filter has the disadvantage that the manufacture of the filter is cumbersome and subsequently the filter is costly, since each of the resonating rods are fixed alternately to the confronting two conductive walls to obtain a high enough coupling coefficient between each of the resonating rods.

FIG. 2 shows the perspective view of another conventional filter, which is called a comb-line type filter, and has been utilized in the VHF bands and the low frequency microwave bands. In the figure, the reference numerals 11-1 through 11-5 are conductive resonating rods with one end thereof left free standing while opposite end thereof short-circuited to the single conductive wall 13-1 of a conductive case 13. The length of each resonating rod 11-1 through 11-5 is selected to be a little shorter than a quarter of a wavelength. The resonating rod acts as inductance (L), and capacitance (C) is provided at the head of each resonating rod for providing the resonating condition. In FIG. 2, said capacitance is accomplished by the dielectric disk **11*a*-1 through 11*a*-5 and the conductive bottom wall 13-2 of the case 13. The gaps 12-1 through 12-4 between each of the resonating rods, and the capacitance between the dielectric disks 11*a*-1 through 11*a*-5, and the bottom wall 13-2 provide the necessary coupling between each of the resonating rods. A pair of antennas 14** are provided for the coupling between the filter and external circuits.

With this type of filter, the resonating rods 11-1 through 11-5 are fixed on the single bottom wall 13-1 and the manufacturing cost can be reduced as far as this point is concerned, but there is the shortcoming in that the manufacture of the capacitance (C) with an accuracy of, for instance, several %, is rather difficult, resulting in no cost merit. Therefore, the advantage of a comb-line type filter is merely that it can be made smaller than an interdigital filter.

Further, although we try to shorten the resonators in the filters of FIG. 1A and/or FIG. 2 by filling dielectric material in a housing, it is almost impossible since the structure of the filters are complicated. It should be noted that the material of the dielectric body for the use of a high frequency filter is ceramics for obtaining the small high frequency loss, and it is difficult to manufacture the ceramics with the complicated structure to cover the interdigital electrodes of FIG. 1A, or the combination of the disks and the rods of FIG. 2. If we try to fill the housing with plastics, the high frequency loss by plastics would be larger than the allowable upper limit.

Further, a dielectric filter which has a plurality of dielectric resonators has been known. However, a dielectric filter has the shortcoming that the size of each resonator is rather large even when the dielectric constant of the material of the resonators is the largest possible.

Accordingly, the present applicant has proposed the filter having the structure of FIG. 3A (U.S. Ser. No. 92,670, now U.S. Pat. Nos. 4,283,697, and 37,419, now U.S. Pat. No. 4,255,729, Canadian application 339,477, GB serial number 7940057, West Germany P2946 836.8, France 79 28588, Holland 7908381, Sweden 7909547-7, Canada, 326,986, and EPC 79101456.6). In FIG. 3A, each resonator has a circular center conductor (31-1 through 31-5), and the cylindrical dielectric body (**31*a*-1 through 31*a*-5) covering the related center conductor, and each of the resonators are fixed on the single conductive plane 33-1 of the housing 33, leaving the air gaps (32-1 through 32-4) between the resonators. The 34 are antennas for coupling the filter with external circuits. The case 33 has the closed conductive walls having the walls 33-1, 33-2 and 33-3 (upper cover wall is not shown). The structure of the filter of FIG. 3A** has the advantage that the length L of a resonator is shortened due to the presence of the dielectric body covering the conductor, and the resonators are coupled with each other although the resonators are fixed on a single conductive plane due to the presense of the dielectric bodies covering the center conductors.

When the two resonators contact with each other as shown in FIG. 3B, those resonators do not couple with each other, because the electrical coupling between the two resonators is completely cancelled by the magnetical coupling between the two resonators. In this case, the dielectric covering 31-1 and 31-2 do not contribute to the coupling between the resonators. On the other hand, when an air space 32-1 is provided between the surfaces of the dielectric bodies 31-1 and 31-2 as shown in FIG. 3C, some electric field (p) originated from one resonator is curved at the surface of the dielectric body (the border between the dielectric body and the air), due to the difference of the dielectric constants of the dielectric body 31-1 or 31-2, and the air, so that the electric field is directed to an upper or bottom conductive wall. That is to say, the electric field (p) leaks, and the electrical coupling between the two resonators is decreased, and so that decreased electrical coupling can not cancell all the magnetic coupling which is not affected by the presence of the dielectric cover. Accordingly, the two resonators are coupled magnetically by the amount equal to the decrease of the electrical coupling. That decrease of the electrical coupling is caused by the leak of the electrical field at the border between the dielectric surface and the air, due to the presence of the air gap 32-1.

The leak of the electric field to an upper and/or bottom conductive wall increases with the length (x) between the two resonators, or the decrease of the electrical coupling increases with that length (x). Therefore, the overall coupling between resonators which is the difference between the magnetic coupling and the electrical coupling increases with the length (x) so long as that value (x) is smaller than the predetermined value ($x_0$). When the length (x) exceeds that value ($x_0$), the absolute value of both the electrical coupling and the magnetic coupling becomes small, and so the total coupling decreases with the length (x).

However, we found that the filter of FIG. 3A has the disadvantage that the leak (p) of the electrical field to an upper and/or bottom wall is considerably affected by the manufacturing error of both the housing and the dielectric cover. That is to say, the small error of the gap between the upper and/or bottom wall and the dielectric cover, and/or the small error of the size of the dielectric cover provides much error for the characteristics of the filter. Further, the filter is sometimes unstable since the resonators are fixed only at one end of them.

Further, we found that the coupling coefficient between resonators is not enough for providing a wideband filter.

SUMMARY OF THE INVENTION

It is an object, therefore, of the present invention to overcome the disadvantages and limitations of a prior high frequency filter by providing a new and improved high frequency filter.

It is also an object of the present invention to provide a high frequency bandpass filter which is small in size, stable in operation, low in price, having the high Q, and the wide bandwidth, and operable in a vibrated circumstance like mobile communication.

The above and other objects are attained by a high frequency filter comprising a conductive closed housing; at least two resonators fixed in said housing; an input means for coupling one end resonator of said at least two resonators to an external circuit; an output means for coupling the other end resonator of said at least two resonators to an external circuit; each resonator comprising of an elongated linear inner conductor with a circular cross section one end of which is fixed commonly at the bottom of said housing, and the other end of which is free standing, and an elongated rectangular parallelepiped dielectric body surrounding said inner conductor; said dielectric body being made of ceramics having at least two pairs of elongated parallel surface planes, the cross section on the plane perpendicular to said inner conductor is rectangular; the thickness of said dielectric body surrounding said inner conductor being sufficient to hold all the electromagnetic energy in the dielectric body except for the energy for coupling between two adjacent resonators, and keep an air gap between adjacent resonators; each resonator being mounted in the housing so that a first pair of parallel surface planes of the dielectric body contact directly with the housing, and said air gap between resonators is defined by other dielectric body surfaces which are perpendicular to said first pair of planes.

According to another embodiment of the present invention, said dielectric body surrounding inner conductors is integral, and common to all the resonators. In this case, the dielectric body has an elongated slit between two adjacent resonators for electromagnetically coupling those resonators.

Preferably, said input means and output means are implemented by a conductive thin film plated on the dielectric body of an end resonator, and said thin film is of course electrically connected to a connector.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 4A:
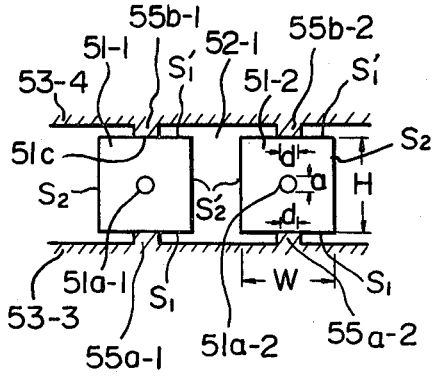
FIG. 4A is the cross sectional view of the present high frequency filter.
Figure 4B:
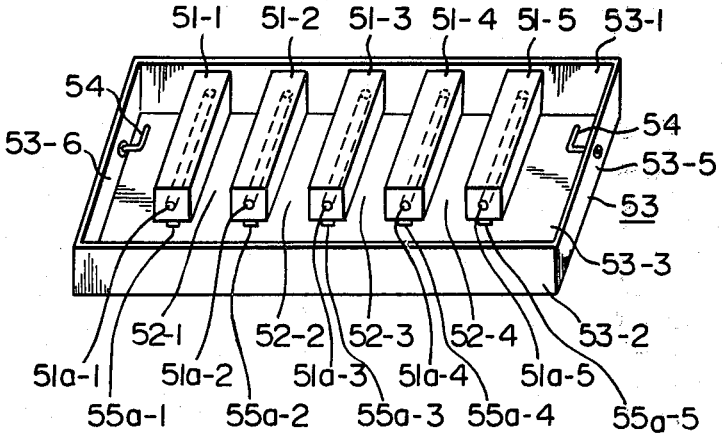
FIG. 4B is the perspective view of the filter of FIG. 4A.

FIGS. 4A and 4B show the structure of the present filter, in which FIG. 4A is the cross sectional view of a part of the present filter, and FIG. 4B is the perspective view of the filter. In those figures, the reference numerals 51-1 through 51-5 are an elongated dielectric body with the square cross section having a first pair of parallel surface planes ($S_1$, $S_1'$) and the other pair of surface planes ($S_2$, $S_2'$) perpendicular to the first ones. That dielectric body is made of ceramics, and has an elongated circular hole along the axis of the same. That circular hole extends from the top to the bottom of the dielectric column. The reference numerals **51*a*-1 through 51*a*-5 are circular linear inner conductors each of which is inserted in the hole of the related dielectric body (51-1 through 51-5). The combination of the dielectric body and the inner conductor compose a resonator. The reference numerals 52-1 through 52-4 are air gaps provided between the two adjacent resonators. The presence of those gaps is important for the operation of the present filter. The reference numeral 53 is a closed conductive housing having the first side plate 53-1, the second side plate 53-2, the third side plate 53-5, the fourth side plate 53-6, the first bottom plate 53-3, and the second bottom plate 53-4. The reference numeral 54 is an antenna, which is provided on the third and the fourth side plates 53-5 and 53-6 for coupling the filter with external circuits. In the embodiment of FIGS. 4A and 4B, said antenna is implimented by an L-shaped conductor as shown in FIG. 4B. The reference numerals 55*a*-1 through 55*a*-5 are elongated projections provided on the bottom plate 53-3, and said projections are provided parallel with one another. The presence of said projection provides the larger coupling coefficient between resonators. The reference numerals 55*b*-1 through 55*b*-5 (not shown) are other elongated projections provided on the second bottom plate 53-4. For the sake of the simplicity of the drawing, the second bottom plate 53-4** is not shown in FIG. 4B.

One end of the inner conductors **51*a*-1 through 51*a*-5 are fixed commonly on the first side plate 53-1, and the other end of those conductors are free standing as shown in FIG. 4B. The dielectric bodies 51-1 through 51-5 which hold the inner conductors 51*a*-1 through 51*a*-5 contact with the conductive projections 55*a*-1 through 55*a*-5, and the 55*b*-1 through 55*b*-5. Preferably, a first pair of confronting surface planes ($S_1$, $S_1'$) of the dielectric bodies are plated with a conductive layer, and those layers are fixed to the projections (55*a*-1 through 55*a*-5, and 55*b*-1 through 55*b*-5**) through a soldering process, so that the center line of the surface planes ($S_1$, $S_1'$) of a dielectric body is positioned on the center of a projection.

In FIG. 4A, the side surface ($S_2$, $S_2'$) with the length H of the dielectric body is exposed to an air space, and the reference numeral **51*c* shows the contact portion between the second bottom plate 53-4 and the dielectric body 51-1. The coupling between the resonators is effected through the side surface plane ($S_2$, $S_2'$) which is perpendicular to the bottom plates 53-4 and 53-5, and the contact portion 51*c* which is parallel to the bottom plates 53-4 and 53-5** does not effect the coupling of the resonators.

The rectangular cross section of a dielectric body is one of the features of the present filter, and it should be appreciated that the dielectric bodies contact with bottom plates of the housing with the projections having the width (d). Therefore, the contact area between a dielectric body and the bottom plates is much larger than that of a prior filter of FIG. 3A which has a circular dielectric body. It should be appreciated in FIG. 3A that a circular dielectric body can contact with the bottom plates only with a thin tangent line.

The large contact area between the dielectric bodies and the bottom plates provides the stable mounting of the resonators to enable the stable operation in a vibrated circumstance like a mobile communication, and the increase of the coupling between the two adjacent resonators.

Figure 5A:
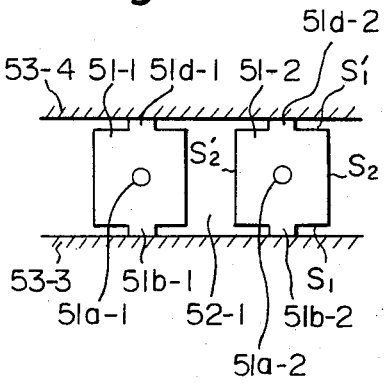
FIG. 5A is the cross sectional view of the modification of the filter of FIG. 4A.
Figure 5B:
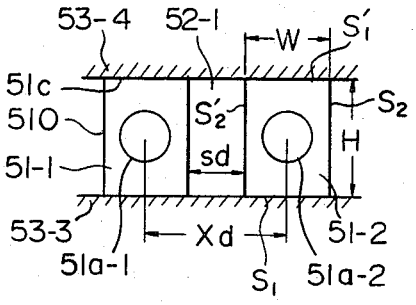
FIG. 5B is the cross sectional view of another modification of the filter of FIG. 4A.

FIGS. 5A, and 5B show some modifications of the cross section of a rectangular dielectric body. In the first modification of FIG. 5A, the elongated dielectric projections (**51*b*-1, 51*b*-2, 51*d*-1, 51*d*-2 et al) are provided integrally on the elongated rectangular dielectric bodies (51-1, 51-2 et al), and instead, the conductive projections (55*b*-1 through 55*b*-5, 55*a*-1 through 55*a*-5**) of FIGS. 4A and 4B are removed. Those dielectric projections are plated with a conductive layer, which is fixed to the bottom plates of the housing through a soldering process.

FIG. 5B shows another modification, in which no projection is provided on a dielectric body or on a bottom plate, but an elongated dielectric body contacts directly with the bottom plates. In those embodiments, the confronting side walls ($S_1$, $S_1'$) of the dielectric bodies are plated with conductive layers which are soldered to the bottom plates of the housing. FIG. 5B is the embodiment that the length H which is the perpendicular side to the bottom plate, is longer than the length W which is the parallel side to the bottom plate.

Those embodiments in FIGS. 4A, 5A, and 5B provide the similar operational effect, and therefore, one of those structures is chosen according to the manufacturing view point of a filter. It should be appreciated in those embodiments that the confronting surfaces ($S_2$, $S_2$;) are flat, but are not curved like the structure of FIG. 3A. Those flat confronting surfaces are the important feature of the present invention, and those flat confronting surfaces provide the larger coupling coefficient between resonators, and the wideband filters. Concerning the ratio of W and H, it is preferable that H is equal to or longer than ½W, because when H is too short, the combination of a dielectric body and an inner conductor operates substantially as a strip line, which does not leak electro-magnetic energy to the outer space, and the coupling effect between the resonators becomes insufficient.

Figure 6:
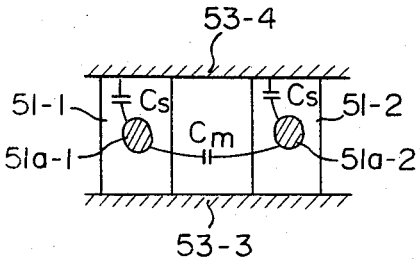
FIG. 6 is the drawing for the theoretical analysis of the filter of FIGS. 4A through 5B, FIGS. 7A through 7C show the structures of other embodiments of the present high frequency filters.

The rectangular dielectric body provides the larger coupling between the two adjacent resonators than a prior circular dielectric body. This fact is explained in accordance with FIG. 6, in which the symbol Cs shows a self capacitance between an inner conductor and the ground, and the symbol Cm shows a mutual capacitance between the two adjacent inner conductors.

The coupling amount K between the two adjacent resonators is shown below.

$$K=K_v+K_i$$

where $K_v$ is the electrical coupling amount, and $K_i$ is the magnetic coupling amount. $K_v$ and $K_i$ are shown below.

$$K_v = (Z_{even} - Z_{odd})/(Z_{even} + Z_{odd} + 2j((Z_{even}Z_{odd})/Z)\tan\beta l) \quad (1)$$
$$= (Z_{even} - Z_{odd})/(Z_{even} + Z_{odd} - (2Z_{even}Z_{odd})/Z_w)$$
$$K_i = -(Z_{even} - Z_{odd})/(Z_{even} + Z_{odd} - 2jZ\cot\beta l) \quad (2)$$
$$= -(Z_{even} - Z_{odd})/(Z_{even} + Z_{odd} - 2Z_w)$$

where $Z_{even}$ is the even mode impedance and is expressed 1/vCs, $Z_{odd}$ is the odd mode impedance and is expressed 1/v(Cs+2Cm), v is the light velocity in the dielectric body, and Z is the load impedance. The load impedance Z and the characteristics impedance $Z_w$ of a resonator has the following relations.

$$Z_w=jZ\cot\beta l.$$

where $\beta$ is the propagation constant in the transmission line which compose a resonator, and l is the length of the inner conductor of a resonator.

Said equation (1) can be changed as follows using the capacitances Cs and Cm.

$$K_v=1/(1+Cs/Cm-(Cs/Cm+2)^2/2vZ_wCs)\approx 1/(1+Cs/Cm) \quad (3)$$

Accordingly, it is quite apparent that the smaller the ratio Cs/Cm is, the larger the coupling amount $K_v$ is obtained. The similar discussion is possible for the magnetic coupling amount $K_i$, and the smaller the ratio Cs/Cm is, the larger the coupling amount $K_i$ is obtained. Comparing the rectangular dielectric body with the circular dielectric body with the assumption that the length between the two inner conductors is constant, and the radius of the circular body is the same as ½ of side of square dielectric body, the square body provides the larger Cm and the larger Cs than a circular body. And, we found through the computation using a digital computer, that the square body provides the smaller ratio Cs/Cm than a circular body does. That is to say, a square dielectric body provides the larger coupling coefficient than a prior circular dielectric body, and the larger coupling coefficient is preferable for reducing the size of a filter. Also, our computer calculation shows that the larger the ratio H/W is, the smaller the ratio Cs/Cm is and the larger the coupling coefficient K is.

Figure 1A:
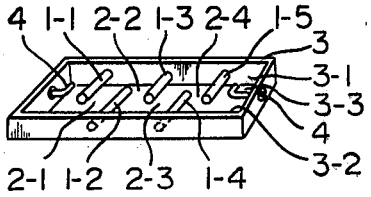
FIG. 1A shows a prior interdigital filter.
Figure 1B:
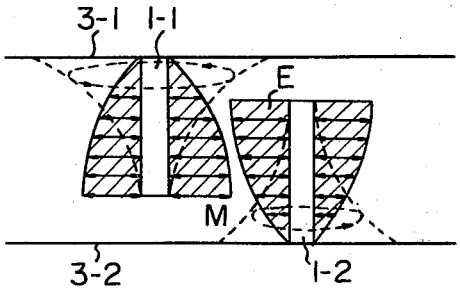
FIG. 1B shows the coupling principle of the interdigital filter of FIG. 1A.
Figure 2:
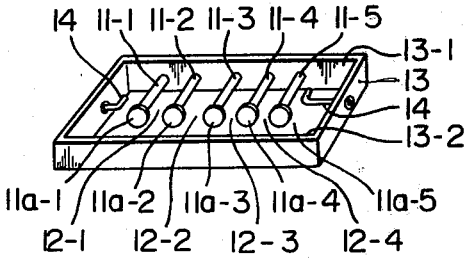
FIG. 2 shows a prior comb line filter.
Figure 3A:
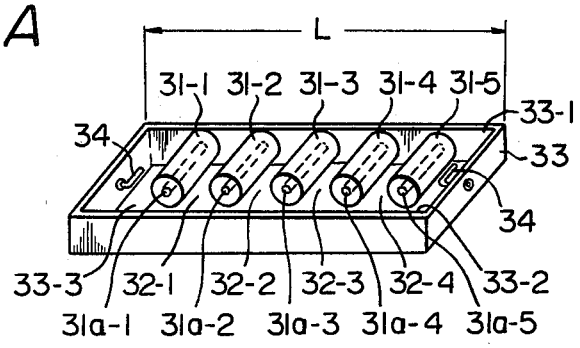
FIG. 3A shows the structure of a prior high frequency filter having resonators with inner conductors and a circular dielectric cover.

Further, our experiments and the theoretical analysis showed that the coupling coefficient in case of a circular dielectric body of FIG. 3A is less than $2.5\times10^{-2}$, while in case of rectangular dielectric bodies, the coupling coefficient larger than $3.5\times10^{-2}$ is obtained. The larger coupling coefficient is preferable to provide a wideband bandpass filter, and so, a rectangular dielectric body is more desirable than a circular dielectric body for a wideband filter.

Considering said equation (3), it should be noted that a projection (55*a*-1 through 55*a*-5, and 55*b*-1 through 55*b*-5 in FIGS. 4A and 4B, and 51*b*-1, 51*b*-2, 51*d*-1 and 51*d*-2 in FIG. 5A) provides the larger coupling coefficient, since due to the presence of that projection, the value Cs in the equation becomes small, and the ratio Cs/Cm becomes small, while maintaining the value Cm unchanged. Further, when the ratio H/W is larger, the value Cs is small, and the value Cm is large, then, the ratio Cs/Cm is small, and the larger coupling coefficient is obtained.

The operation of a dielectric cover is (1) to shorten a resonator, and (2) to effect the coupling of the resonators. Due to the presence of the dielectric cover, the wavelength $\lambda_g$ in a resonator becomes $\lambda_g=\lambda_0/\epsilon_e$, where $\lambda_0$ is the wavelength in the free space, and $\lambda_e$ is the effective dielectric constant of the dielectric body. That effective dielectric constant $\lambda_e$ is usually smaller than the dielectric constant $\lambda_r$ itself, because the housing is not completely filled with the dielectric body.

Figure 3B:
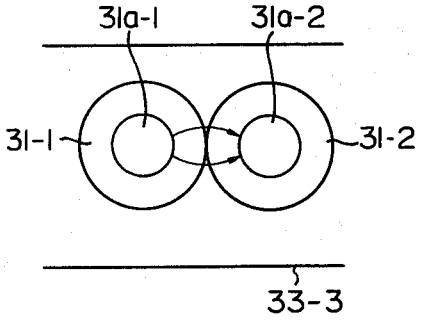
FIG. 3B and FIG. 3C show the coupling principle of the filter of FIG. 3A.
Figure 3C:
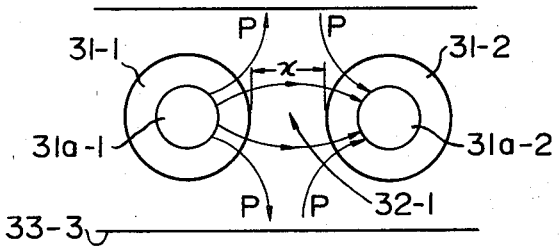

The dielectric cover also effects the coupling of the resonators with one another as described in accordance with FIGS. 3B and 3C. If there is no dielectric cover provided, the resonators would not couple with the adjacent resonators when the resonators are positioned on a single bottom plate. In order to effect that coupling, the electro-magnetic energy of the resonator must be confined in the dielectric body. Preferably, all the electro-magnetic energy except for the energy utilized for the coupling with the adjacent resonators is concentrated in the dielectric body.

In order to confine the electromagnetic energy in the dielectric body, that dielectric body must have some thickness, and the necessary thickness is defined according to the diameter of an inner conductor. In the preferred embodiment of the present filter, the ratio of the side H of the cross section of the dielectric body, to the diameter (a) (see FIG. 4A) is chosen in the range from 2.5 to 5.0, on the condition that the cross section of the dielectric body is square (H=W in FIG. 4A), and the dielectric constant of the dielectric body is 20. If the thickness of the dielectric body is thinner than that value, the electro-magnetic energy in the resonator diverges or escapes from the resonator, and not sufficient coupling effect is obtained. Also, the thin dielectric cover decreases the value Q of the resonator on the no-load condition. If the dielectric cover is thinner than that value, the no-load Q is decreased to 70% as compared with the resonator having sufficient thickness of the dielectric cover. If the dielectric cover were too thick, no gap space between resonators would be provided, so the value 5.0 is the upper limit of said ratio. According to the preferred embodiment of the present filter, the values H=W=12 mm, $\epsilon_r$=20, and a=4 mm.

When the dielectric constant of the dielectric cover is not 20, the above figures must be changed as follows.

$$2.5\sqrt{20/\epsilon_r} \leqq H/a \leqq 5.0\sqrt{20/\epsilon_r}$$

where $\epsilon_r$ is the dielectric constant of the dielectric body, H is the length of the side of the square cross section of the dielectric body, and (a) is the diameter of the inner conductor. In the above discussion, it is assumed that the whole length of an inner conductor is covered with a dielectric cover having the square cross section, and the length of a dielectric cover is the same as the length of an inner conductor.

When the above relations are satisfied, the 90–99.9% of the electromagnetic energy is concentrated in the dielectric body, and the rest of the energy (0.1–10%) couples the resonator with the adjacent resonators.

Figure 7A:
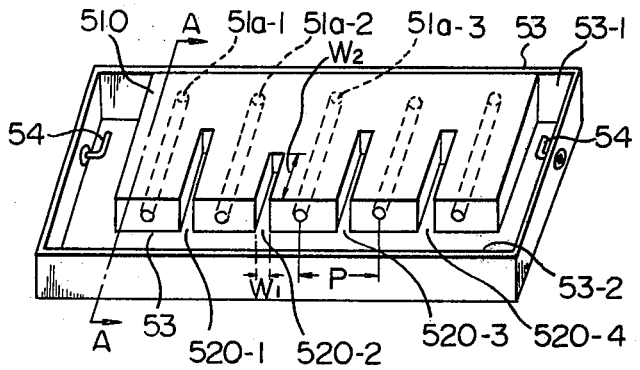
Figure 7B:
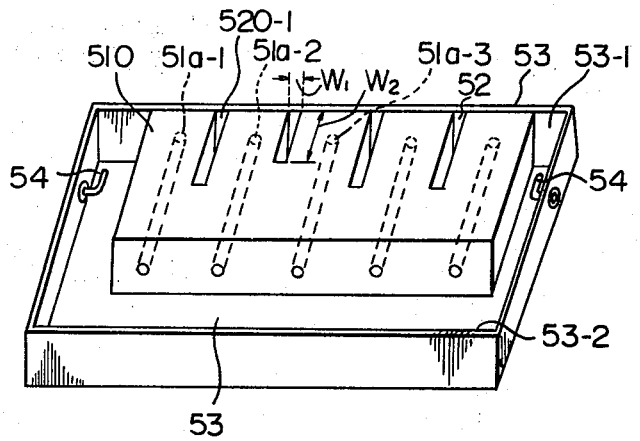
Figure 7C:
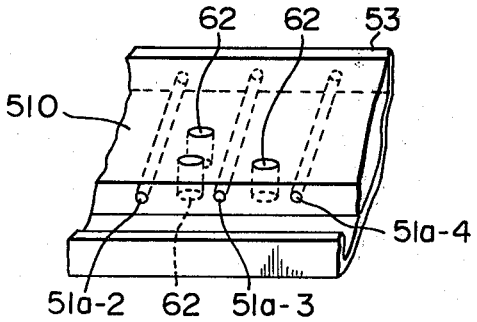

Some other structures of the present filter are described in accordance with FIGS. 7A 7B and 7C, in which the same members as those of FIG. 4A have the same reference numerals. The feature of those filters is that each of the resonators are not separated, but are combined. The flat integrated rectangular dielectric plate 510 has a plurality of elongated linear holes in which the inner conductor rods 51*a*-1 through 51*a*-5 are inserted. Between those holes, the dielectric plate 510 has slits 520-1 through 520-4 with the width $w_1$ and the length $w_2$. Those slits operate similarly to the air gaps (52-1 through 52-4) between the resonators of the previous embodiments. Of course, one end of the inner conductors are electrically connected to the single conductive plate 53-1 of the housing 53, and the other end of the inner conductors is free standing. The embodiment of FIG. 7A has the slits from the free standing end, while the embodiment of FIG. 7B has the slits from the common conductor plate 53-1. The length of the inner conductors is selected to be $\frac{1}{4}$ wavelength ($\frac{1}{4}\lambda_g$). The upper and the bottom surfaces of the dielectric plate 510 are plated with thin conductive layer, which is soldered to the housing plates. The width $w_1$ and the length $w_2$ of the slits are designed according to the desired coupling amount between the resonators, and/or the desired characteristics of the filter.

FIG. 7C is the modification of FIG. 7A and FIG. 7B, and FIG. 7C has a hole 62 between conductor rods instead of the slits.

Figure 8A:
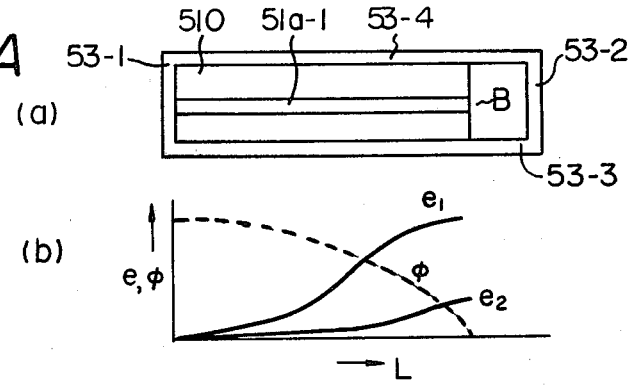
FIGS. 8A through 8C are the drawings for the explanation of the operation of the filters of FIGS. 7A through 7C, FIGS. 9A and 9B show the auxiliary coupling means for effecting the coupling to two resonators.
Figure 8B:
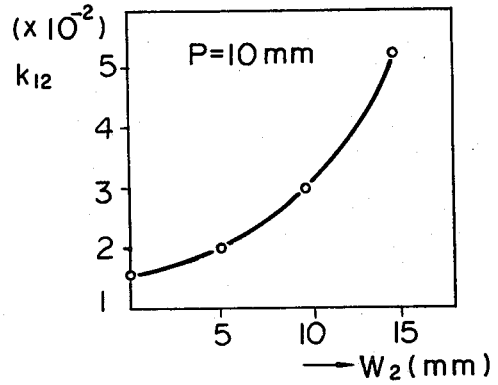
Figure 8C:
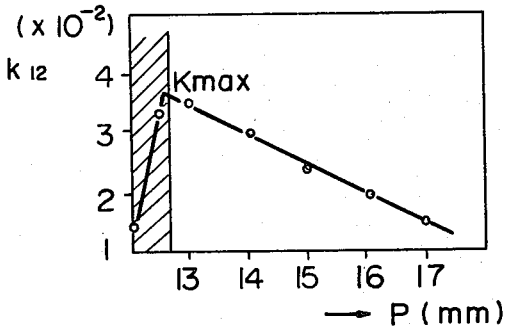

Next, some coupling analysis is described in accordance with FIGS. 8A through 8C.

FIG. 8A shows the cross sectional view at the line A-A of FIG. 7A, and the curves of the electrical coupling between the two adjacent resonators ($e_1$ and $e_2$), and the magnetic coupling $\phi$, where the horizontal axis of FIG. 8A(*b*) is the length L from the bottom of the inner conductor. The electrical coupling $e_1$ shows the case that no slit is provided, and the electrical coupling $e_2$ shows the case that a slit is provided. The electrical coupling ($e_1$ or $e_2$) is zero at the fixed end of an inner conductor (see the description of FIG. 1B), and is maximum at the free standing end of an inner conductor, while the magnetic coupling $\phi$ is the maximum at the bottom of an inner conductor and is zero at the free standing end. When no slit is provided, the ablosute value of the electrical coupling $e_1$ is the same as the magnetic coupling $\phi$, and the sign of the former is opposite of the latter, and then, those couplings are cancelled with each other, thus, no coupling is effected after all between the resonators. On the other hand, when a slit is provided between the two resonators, the electrical coupling $e_2$ is considerably decreased as compared with $e_1$, since the electrical field is partially directed to the conductive housing through the slit as described in accordance with FIG. 3C. As the magnetic coupling $\phi$ is not affected by the presence of a slit, the difference between the magnetic coupling $\phi$ and the electrical coupling $e_2$ effects the coupling between the resonators.

FIGS. 8B and 8C show some experimental results. FIG. 8B shows the relations between the coupling coefficient $K_{12}$ between the first resonator and the second resonator, and the width $w_2$ of the slit between the two resonators, on the condition that the length between the center of the two inner conductor is p=10 mm (see FIG. 7A), and the unload Q of the resonators is 1200–1300.

FIG. 8C shows the relationship between the coupling coefficient $K_{12}$ between the two resonators and the length p between the centers of the two inner conductors, on the condition that the dielectric body is square having the side of 12 mm in the structure of FIG. 7A is clear from FIG. 8C that the coupling increases first when the length p increases, and then, decreases when the length p exceeds the predetermined value. The necessary coupling amount for the filter having the bandwidth 1–3% of the center frequency is $K_{12}=1.5\times10^{-2}$ to $4.0\times10^{-2}$. Usually, the shaded area that the coupling increases with the increase of the length p is not utilized because the length p is critical and must be too accurate for an actual design of a filter.

Figure 9A:
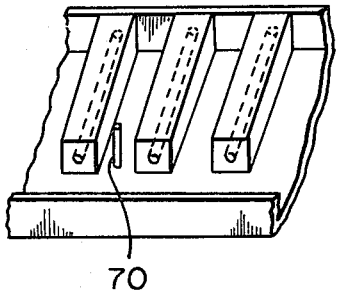
Figure 9B:
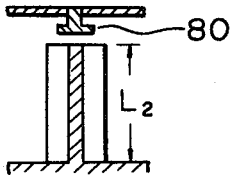

Next, some adjustment means for adjusting the coupling coefficient between two resonators are described in accordance with FIGS. 9A and 9B.

FIG. 9A shows a thin conductive post 70 located on the bottom plate of the housing so that the post is perpendicular to the inner conductors. That post 70 operates to increase the coupling of a the resonators. Although the post 70 in FIG. 9A is located in the air gap between the resonators of the embodiment of FIG. 4B, it should be appreciated that the post is also applicable to the embodiments of FIGS. 7A and 7B in which that post is located in the slit.

FIG. 9B shows a conductive disk 80, which provides the capacitance between the conductive housing 53 and the inner conductor. That capacitance also increases the coupling between the resonators. Preferably, that disk 80 is engaged with the housing through a screw, through which the length between the disk and the inner conductor is adjusted to provide the fine adjusting of the coupling amount. In case of FIG. 9B, the length $L_2$ of the inner conductor can be shortened as compared with other embodiments which have no disk.

Next, some modifications of the structure of an antenna for exciting the present filter is described in accordance with FIGS. 10A through 10F. It should be noted that an antenna in the previous embodiments is an L-shaped conductor line.

Figure 10A:
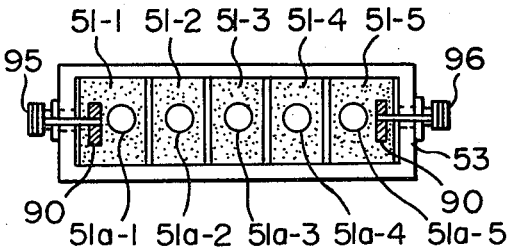
FIGS. 10A through 10B show an input and/or output means for the present filter.

In those figures (FIG. 10A through FIG. 10F), an antenna is implemented by a thin conductive film plated on the top surface of the free end of the dielectric cover so that the film does not contact directly with the inner conductor. FIG. 10A is the plane view of the filter utilizing the plated antenna, and FIG. 10B is the elevational view of the same. In those figures, the same reference numerals as those in the previous embodiments show the same members. In FIGS. 10A and 10B, the reference numeral 90 show a conductive thin film plated on the extreme end of dielectric covers 51-1 and 51-2, and in those embodiments, a film 90 is attached at the top of the dielectric cover. Of course, that film can also be attached on the side surface of the dielectric body. The film 90 is attached on a dielectric body through the silk screen process of silver, or an etching process of silver. The reference numerals 95 and 96 are connectors mounted on the housing 53 for coupling the filter with the external circuits. The outer terminal of those connectors 95 and 96 is connected directly to the housing 53, and the inner terminal of those connectors is connected to the film 90 through a thin lead wire through a soldering process. Of course, the inner conductors 51a-1 through 51a-5 are covered with dielectric covers 51-1 through 51-5, respectively, and are fixed on the single conductive plane of the housing 53.

Figure 10D:
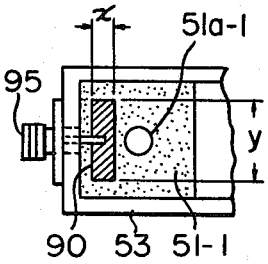
FIG. 10D shows an enlarged view of the input means for the analysis in FIG. 10C, FIGS. 10E and 10F are modifications of an input and/or output means of FIGS. 10A and 10B, and FIGS. 11A through 11D are curves for the actual design of the present filter.
Figure 10B:
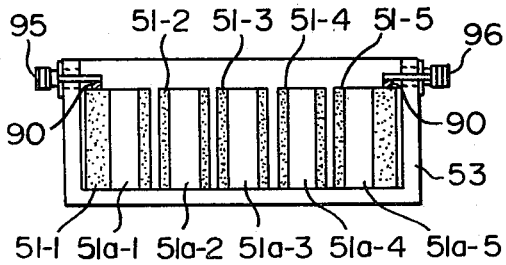
Figure 10E:
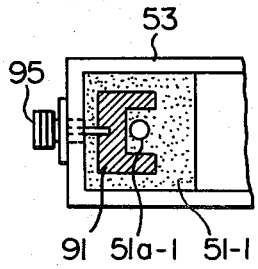
FIG. 10C is the curve showing the characteristics of an input and/or output means of FIGS. 10A and 10B.
Figure 10C:
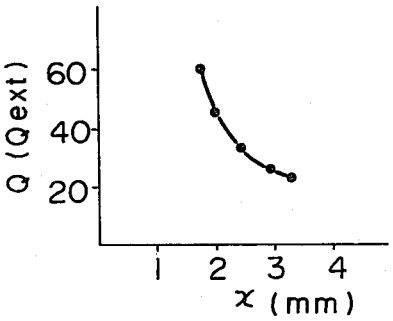
Figure 10F:
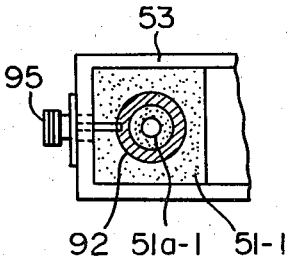

FIG. 10C and FIG. 10D show the relations between the size of the film 90 and the effect of the antenna. In FIG. 10D, the film 90 is rectangular with the length x and y, attached on the top surface of the dielectric body 51-1. The length y is fixed to 10 mm, and the width (x) is changed in the experiment. FIG. 10C shows the curve between that width (x) and the external Q which represents the effect of the antenna of a filter. Since the desired external Q for implementing the filter having the bandwidth of 3% of the center frequency is approximately 25, the width (x) is about 3 mm as apparent from FIG. 10C. Further, since the allowable error of the external Q for the filter when the filter is used with no conditioning, is about 5%, the accuracy of the size of the film is ±0.1 mm as apparent from FIG. 10C. That accuracy is easily obtained by a silk screen process or an etching process. FIGS. 10E and 10F are the modifications of the shape of the film 90. The film 91 of FIG. 10E is U-shaped surrounding the center inner conductor. The film 92 of FIG. 10F is ring-shaped surrounding the inner conductor. Those U-shaped film and/or ring-shaped film can also operate as an antenna for exciting a filter.

Next, some theoretical and experimental characteristics of the present filter based upon the structure of FIGS. 4A through 5C is described in accordance with FIGS. 11A through 11D. It should be noted that the characteristics of a filter are defined by the characteristics of each of the filters and the coupling coefficient between the filters.

Figure 11A:
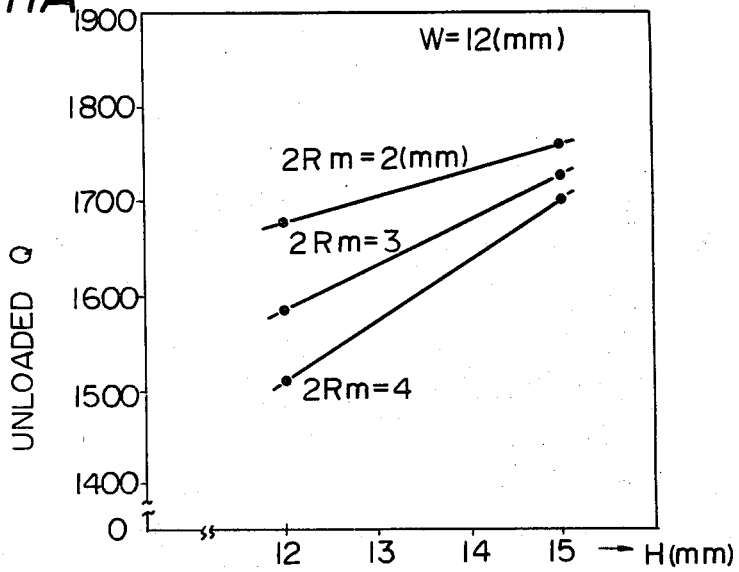

FIG. 11A shows the theoretical relations between the width H (see FIG. 4A) of a dielectric body and the unloaded Q of the resonator, where the width W of the dielectric body is W=12 mm, the dielectric constant $\epsilon_r$ of the dielectric body is 20, and the tan δ of the dielectric body is tan $\delta=1.4\times10^4$. In FIG. 11A, the parameter $2R_m$ is the diameter of the inner conductor of a resonator.

The theoretical unloaded Q of a resonator of FIG. 11A is calculated as follows.

$$1/Q=(1/Q_c)+(1/Q_d)$$

where Q is the unloaded Q of a resonator, $Q_c$ is the Q of an inner conductor, and $Q_d$ is the Q of a dielectric body.

$$Q_c=27.3/\alpha_c'$$

$$\alpha_c'=8.686\times\alpha_C\times\lambda_g$$

$$\alpha_c = (R_m\epsilon_0\mu_o)\int_{l_1+l_2}\epsilon_r(\delta\phi/\delta n)^2dl)/)2\mu_0\int_{l_2}\epsilon_o\epsilon_r(\delta\phi/\delta n)^2dl \text{ Neper/m}$$

$$Q_d=27.3/\alpha_d'$$

$$\alpha_d'=8.686\times\alpha_d\times\lambda_g$$

$$\alpha_d = 2\pi f\tan\alpha\epsilon_o\epsilon_r\iint_s((\delta\phi/\delta x)^2+(\delta\phi/\delta y)^2)ds/\mu_o\int_{l_2}\epsilon_o\epsilon_r(\delta\phi/\delta n)^2dl \text{ Neper/m}$$

Figure 11B:
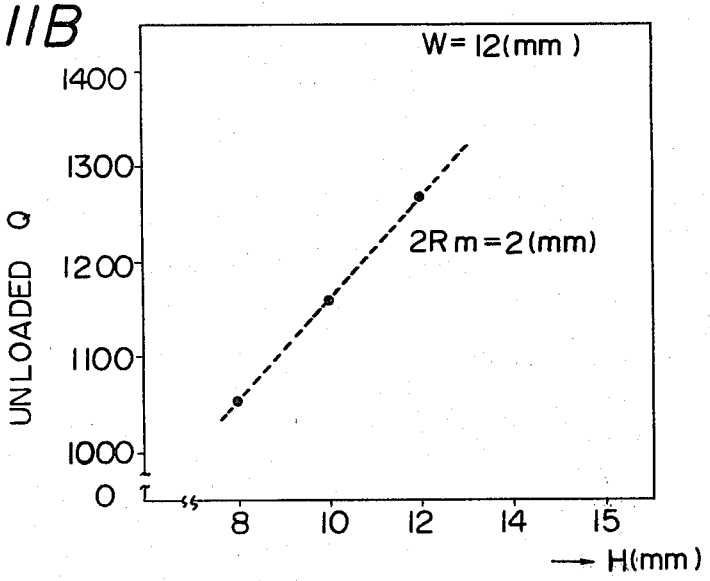

FIG. 11B is the experimental result of the unloaded Q where the width W of the dielectric body is W=12 mm, and the diameter $2R_m$ is $2R_m=2$ mm. It should be appreciated that the value of the experimental unloaded Q is approximately 80% of the theoritical value from FIGS. 11A and 11B.

Figure 11C:
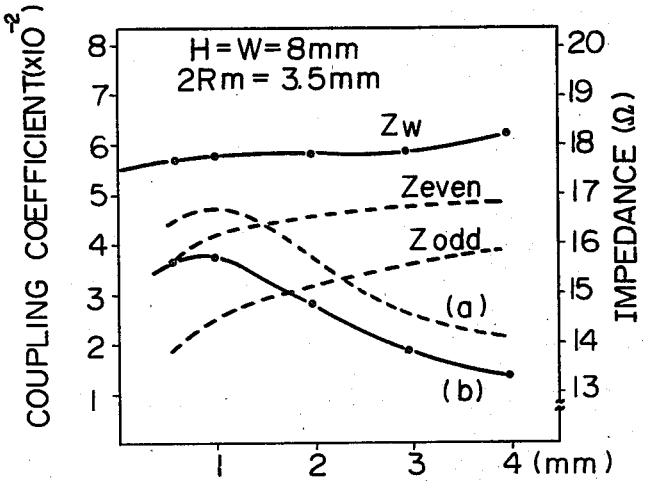

FIG. 11C shows the theoretical coupling coefficient K between the two adjacent resonators (the curve (a)), and the experimental coupling coefficient (the curve (b)), where the horizontal axis shows the spacing between two resonators, the vertical axis shows the value of the coupling coefficient k, the values H and W are H=W=8 mm, and the value $2R_m$ is $2R_m=3.5$ mm. The curves $Z_w$, $Z_{even}$, and $Z_{odd}$ are theoretical values of the characteristics impedance, the even mode impedance, and the odd mode impedance, respectively, which have been described before. It should be noted that the experimental value is close to the theoretical value. The curve (b) of FIG. 11C has the similar nature to that of FIG. 8C, and has the increasing characteristics when the duration between the two resonators is small, and the decreasing characteristics when the duration between the two resonators exceeds the predetermined value (that predetermined length is about 1 mm in FIG. 11C).

Figure 11D:
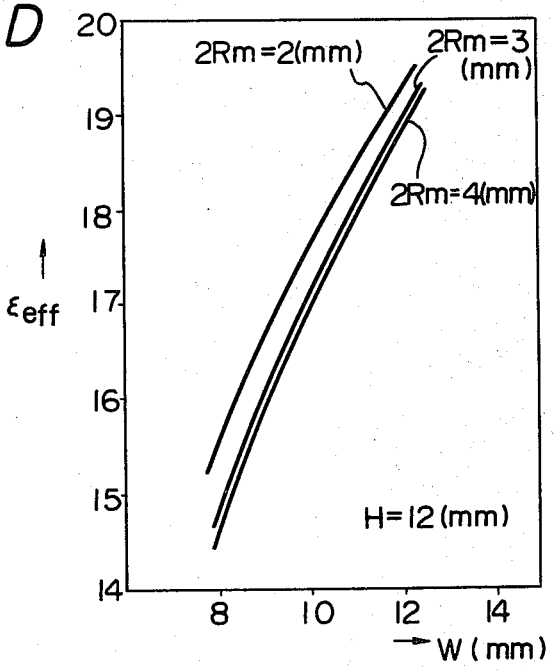

FIG. 11D shows the curves of the theoretical value of the effective dielectric constant $\epsilon_{eff}$, which defines the length of a resonator, where the length H is H=12 mm, the horizontal axis shows the length W (mm), the vertical axis shows the effective dielectric constant $\epsilon_{eff}$, and the parameter is the diameter $2R_m$ of an inner conductor, the dielectric constant $\epsilon_r$ of the dielectric body is $\epsilon_r=20$, and the tan δ of the dielectric body is tan $\delta=1.4\times10^{-4}$.

Said effective dielectric constant $\epsilon_{eff}$ is expressed as follows.

$$\epsilon_{eff}=(\lambda_o/\lambda_g)^2=\sqrt{C_i/C_0}$$

where $C_0$ is the capacitance between an inner conductor and a conductive housing when no dielectric body is filled in the housing (air is filled in the housing), $C_i$ is the capacitance between an inner conductor and a housing when the dielectric body in the shape of FIG. 5B is mounted, $\lambda_0$ is the wavelength in the free space, and $\lambda_g$ is the wavelength in the resonator.

Accordingly, the length of an inner conductor of the present invention is determined as follows.

$$\tfrac{1}{4}\lambda_g=\lambda_o/(4\lambda_{eff})$$

Usually, the value $\lambda_{eff}$ is smaller than $\lambda_r$, because the housing is not completely filled with the dielectric body.

In FIGS. 11A through 11D, the unloaded Q for minimizing the insertion loss of the filter is determined according to the length H of the dielectric body, and the diameter $2R_m$ of the inner conductor (FIGS. 11A and 11B), and the coupling coefficient between resonators which determine the bandwidth of the filter is given by FIG. 11C, and the length of the resonator or the length of an inner conductor is determined using FIG. 11D.

In our experiments, we could produce the filter having five resonators for 850 MHz band, and the volume of the filter was 20 $cm^3$ in case of the structure of FIG. 5A, and 28 $cm^3$ in the structure of FIG. 5B. Also, the insertion loss of the filter was 1.5 dB, and 1.1 dB for the structures of FIG. 5A, and FIG. 5B, respectively.

Further, our experiments showed that the cross section of an inner conductor must be circular. When that cross section is rectangular, the loss of the filter is larger as compared with that of the circular cross section.

As described in detail, according to the present invention, all the resonators are secured on a single plane of a housing, and thus, the structure is simple. Also, the coupling coefficient between resonators is stable due to the use of a rectangular dielectric body, which also shortens the length between resonators to provide a small sized filter. Further, that coupling coefficient can be adjusted by using the structure of FIG. 9A or FIG. 9B. Further, the coupling with external circuits is also stable by using the antenna structure of FIGS. 10A through 10F. Therefore, the present invention allows the mass production of a small sized filter with stable characteristics.

From the foregoing, it will now be apparent that a new and improved high frequency filter has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A high frequency filter comprising a conductive closed housing, at least two resonators fixed in said housing, an input means for coupling one end resonator of said at least two resonators to an external circuit, an output means for coupling the other end resonator of said at least two resonators to an external circuit, wherein electromagnetic energy is applied to said filter through said input means and exits therefrom through said output means, characterized in that (a) each resonator comprises an elongated linear inner conductor with a circular cross section one end of which is fixed commonly at the bottom of said housing, and the other end of which is free standing, and an elongated rectangular parallelepiped dielectric body surrounding said inner conductor, (b) said dielectric body is made of ceramics having two pairs of elongated parallel surface planes, the cross section on the plane perpendicular to said inner conductor is rectangular, (c) the thickness of said dielectric body surrounding said inner conductor is sufficient to hold all the electromagnetic energy in the dielectric body except for the energy for coupling between two adjacent resonators, and keep an air gap between adjacent resonators, (d) each resonator is mounted in the housing so that a first pair of parallel surface planes of the dielectric body contact directly with the housing, and said air gap between resonators is defined by other dielectric body surfaces which are pendicular to said first pair of planes.

2. A high frequency filter according to claim 1, wherein the length of said inner conductor and said dielectric body is substantially ¼ wavelength.

3. A high frequency filter according to claim 1, wherein the cross section of said dielectric body is square.

4. A high frequency filter according to claim 1, wherein the width (W) of said first pair of planes of the dielectric body is smaller than the width (H) of the second pair of planes.

5. A high frequency filter according to claim 1, wherein said dielectric body has a pair of elongated projections on said first pair of surface planes, and said projections contact with the housing.

6. A high frequency filter according to claim 1, wherein said housing has a plurality pairs of projections which contact with each dielectric body.

7. A high frequency filter according to claim 1, wherein a conductive post for adjusting coupling between resonators is provided in said air gap so that said post is perpendicular to an inner conductor.

8. A high frequency filter according to claim 1, wherein a disk is provided between the top of each inner conductor and the housing, the duration between the disk and the inner conductor is adjustable, for adjusting coupling between resonators.

9. A high frequency filter according to claim 1, wherein said input means and said output means have a conductive film plated at the top of the dielectric body of the extreme end resonators.

10. A high frequency filter according to claim 1, wherein said dielectric bodies are fixed to the housing through soldering process.

11. A high frequency filter according to claim 1, wherein the height (H) of the dielectric body between a pair of bottom plates of the housing, and the diameter (a) of an inner conductor satisfies the following relations;

$$2.5\sqrt{20/\epsilon_r} \leqq H/a \leqq 5.0\sqrt{20/\epsilon_r}$$

where $\epsilon_r$ is the dielectric constant of the dielectric body.

12. A high frequency filter comprising of a conductive closed housing, at least two resonators fixed in said housing, an input means for coupling one end resonator of said at least two resonators to an external circuit, an output means for coupling the other end resonator of said at least two resonators to an external circuit, wherein electromagnetic energy is applied to said filter through said input means and exits therefrom through said output means, characterized in that (a) said resonators comprise of a single rectangular parallelpiped dielectric body having at least two elongated parallel holes each filled with an inner conductor, (b) one end of each inner conductor is fixed commonly at the bottom of said housing, and the other end of which is free standing, (c) said dielectric body is made of ceramics having a slit between inner conductors, (d) the thickness of said dielectric body surrounding said inner conductor is sufficient to hold all the electromagnetic energy in the dielectric body except for the energy for coupling two adjacent resonators.

13. A high frequency filter according to claim 12, wherein said slit extends from the plane that the inner conductors are fixed.

14. A high frequency filter according to claim 12, wherein said slit extends from the plane that the inner conductors are free standing.

15. A high frequency filter according to claim 12, wherein the length and the width of said slit is determined according to the requested coupling coefficient between adjacent resonators.

16. A high frequency filter according to claim 12, wherein a conductive post is provided in said slit to adjust coupling coefficient between resonators.

17. A high frequency filter according to claim 12, wherein said dielectric body is soldered to the housing.

* * * * *